United States Patent [19]

Shibata

[11] Patent Number: 4,898,848

[45] Date of Patent: Feb. 6, 1990

[54] THERMAL LABEL WITH REMOISTENABLE ADHESIVE

[75] Inventor: Tomoo Shibata, Irvine, Calif.

[73] Assignee: Ricoh Electronics, Inc., Irvine, Calif.

[21] Appl. No.: 208,669

[22] Filed: Jun. 20, 1988

Related U.S. Application Data

[63] Continuation of Ser. No. 929,342, Nov. 12, 1986, abandoned.

[51] Int. Cl.[4] ..... B41M 5/18

[52] U.S. Cl. ..... 503/200; 428/336; 428/350; 428/353; 428/354; 428/355; 428/478.2; 428/478.8; 428/514; 428/522; 428/913; 503/226

[58] Field of Search ..... 428/350, 40, 195, 336, 428/343, 353–355, 478.2, 478.8, 514, 522, 913, 914; 503/200, 226; 427/150–152

[56] References Cited

U.S. PATENT DOCUMENTS 3,275,469 9/1966 Streit ..... 428/350

*Primary Examiner*—Bruce H. Hess

*Attorney, Agent, or Firm*—Walter A. Hackler

[57] ABSTRACT

A thermosensitive recording label includes a thermosensitive color-forming layer disposed on one side of a substrate for creating a display of images when the temperature of selected portions of the thermosensitive color-forming layer are heated above an activated temperature. A remoistenable type adhesive is disposed in viscous form on an opposite side of the substrate and dried thereon without heating the thermosensitive color-forming layer above its activation temperature. The remoistenable adhesive does not include any organic solvents or substances which may cause bleed-through to the substrate and into the color-forming layer. Therefore, a barrier layer is not necessary therebetween. In addition, a protective, or barrier layer, may be disposed on top of the thermosensitive color-forming layer to prevent fading or discoloration by exterior contaminants.

8 Claims, 1 Drawing Sheet

THERMAL LABEL WITH REMOISTENABLE ADHESIVE

This application is a continuation of application Ser. No. 929,342, filed Nov. 12, 1986, now abandoned.

The present invention is directed generally to thermosensitive recording labels and more particularly is directed to a thermosensitive recording label utilizing a remoistenable adhesive and its method of manufacture.

Thermosensitive recording labels have been developed over the years as an improvement over conventional labels printed with oily or liquid-based inks. Thermosensitive labels are particularly useful in point-of-packaging or point-of-sale operations. In these situations, the goods being packaged and marked may have varying characteristics such as individual weights and/or prices, which must be individually recorded and marked on the packages via the labels. This requires the labels to be imprinted in a simultaneous fashion and coordinated with the goods arriving at the packaging station so that there is a one-to-one relationship between the label being imprinted and the goods being packaged and identified. This operation naturally requires the labels to be printed on site.

For many years, the imprinting of such labels has been done with oily or water-based inks. Experience has shown that this process is quite messy, because not only do the oily and water-based inks tend to smear if insufficient drying time is not provided after printing and before the label is used on the goods, but the process itself necessitates the use of fluids inks in the printing machine which increases the probability of contaminating labels as well as personnel and equipment through spillage and leakage of the fluid inks. With high speed packaging techniques, the procedure may be limited by the imprinting process and the time required to dry the ink on the labels.

To increase productivity and the rate at which goods can be packaged and labeled, as well as eliminate the messy aspects of fluid ink printing, thermosensitive labels have been developed.

This type of label utilizes a thermosensitive color-forming material disposed on a substrate which undergoes color formation upon being heated to above an activation temperature. A heated printing head is used to apply heat to preselected portions of the label in order to produce images thereon corresponding to alphanumerical characters, or images, for identifying the packaged goods. While this type of label greatly increases the printed label production rate and is much cleaner because it uses no consumable oily or water-based inks, problems have arisen in both the manufacture and use of such labels.

For economical production of the thermosensitive labels, they must be manufactured at high speeds. Because of the thermosensitivity of the labels, heat must be avoided during the manufacture thereof, otherwise, undesirable color formation or total coloration of the lable may occur during its manufacture, thus rendering the product unusable. Consequently, thermosensitive labels have heretofore been manufactured using a pressure-sensitive adhesive so that a layer of adhesive can be laminated to a substrate without the application of heat.

Disadvantages of a thermosensitive label with a pressure-sensitive adhesive reside in the manufacturing cost of the label, the inconvenience in use thereof and the bulk of the label.

Since the pressure-sensitive adhesive is tacky and will stick to most surfaces, it must be protected during storage by a releasable liner, or backing sheet, from which the label must be peeled in order to apply to the goods. Without the use of such a releasable backing sheet, the labels, which are typically stored in rolled form, would stick to one another thereby inhibiting their fast separation from one another before use.

It is also important to note that the backing sheet may represent up to 40 percent or more of the total thickness of the final label as stored. It also represents approximately one-half of the weight of a roll of labels. Hence, it can be easily appreciated that the elimination of the backing sheet enables almost twice as many usable labels to be stored in a given roll of labels, or stack of labels, and, of course, the total weight of such a roll would be significantly less than the weight of the same number of labels having a backing sheet attached thereto.

Other associated cost-savings would flow from the elimination of the backing paper. Such savings would include reduced shipping costs, reduced storage costs, as well as reduced handling and, importantly, the total elimination of waste product. A packager using the labels must peel the label from the backing sheet after it is imprinted, and place it upon the packaged goods. The waste product in this operation is the backing sheet. This represents a significant handling and disposable problem, as half of the delivered label product, namely, the backing sheet, must be separately handled and discarded.

Another disadvantage in the use of a pressure-sensitive type adhesive with a thermosensitive label is the fact that such adhesive agents, which may be an acrylic adhesive, a styrene-butadiene rubber latex adhesive, or a rubber adhesive, typically include emulsifying agents, or organic solvents, which can migrate into the color-forming layer, causing unwanted color formation, or fading. This is typically known in the art as bleed-through.

To prevent bleed-through, a barrier layer is disposed between the color-forming layer and the pressure-sensitive adhesive. It should be apparent that the application of this barrier layer increases both the number of steps necessary to manufacture the label and the overall cost of the label.

The present invention overcomes many of the disadvantages of the hereinbefore produced thermosensitive recording labels. It has been found that remoistenable adhesive can be applied to a thermosensitive recording label substrate without heating of the thermosensitive layer to its activation temperature. Because the adhesive is remoistenable, no backing sheet is necessary thus facilitating handling of the thermosensitive layer by significant reduction in storage and transportation costs as well as eliminating the disposable of any waste products at its point of use.

Further, a label in accordance with the present invention, utilizing a remoistenable type adhesive enables the production of a thermosensitive recording label without a barrier layer between the adhesive and the color-forming layer. This reduces both the cost of the label and the complexity of manufacture, because less steps are required.

SUMMARY OF THE INVENTION

A thermosensitive label in accordance with the present invention, includes a substrate and thermosensitive color-forming layer means disposed on one side of the substrate for creating a display of images when the temperature of selected portions of the thermosensitive color-forming layer means are heated to above an activation temperature. A remoistenable adhesive is disposed on an opposite side of the substrate with the remoistenable adhesive being disposed on the substrate in a viscous form and dried on a substrate without heating the thermosensitive color-forming layer above the activation temperature.

Importantly, because the remoistenable adhesive does not include any organic solvents or substances which may cause bleed-through, a barrier layer is not necessary, the substrate may comprise uncoated paper stock.

More particularly, the thermosensitive label according to the present invention, may include a remoistenable adhesive which comprises a casein-vinyl acetate having a solids content of about 70 percent by weight when applied to the opposite side of the substrate. It has been found that effective adherence to packaged goods can be achieved when the remoistenable adhesive has a thickness of between about 0.5 mil and 1.5 mil. The thermosensitive color-forming layer may comprise a colorless or light-colored leuco dye and an acidic substance capable of causing the leuco dye to undergo color formation upon heating of the thermosensitive label to a temperature greater than the activation temperature, which my be at most about 60 degrees centigrade.

For some applications, the thermosensitive label in accordance with the present invention may further include a barrier layer or means which is disposed over the thermosensitive color-forming layer for preventing undesired color formation and/or fading of desired color formation in the color-forming layer by exterior contaminants.

A method of manufacturing a thermosensitive label according to the present invention includes depositing a thermosensitive color-forming layer on one side of the substrate, with the thermosensitive color-forming layer enabling the display of images when the temperature of selected portions of the thermosensitive color-forming layer means are heated above an activation temperature, and depositing a remoistenable viscous adhesive on an opposite side of the substrate.

The thermosensitive color-forming layer and the remoistenable viscous adhesive are applied at a temperature below the activation temperature of the thermosensitive color-forming layer. To complete the manufacturing process, the remoistenable viscous adhesive is dried without raising the temperature of the thermosensitive color-forming layer to the activation temperature. More particularly, the application of the thermosensitive color-forming layer and adhesive layer is performed below an activation temperature of 60 degrees centigrade and the remoistenable adhesive is dried by blowing room temperature air over the remoistenable adhesive.

In addition, the manufacture in accordance with the present invention, may include the step of disposing a barrier layer over the thermosensitive color-forming layer. The remoistenable viscous adhesive is disposed on the substrate with a thickness of between about 0.5 and about 1.5 mil and in order to manufacture the label at a rate of between about 90 meters per minute and about 120 meters per minute, the viscous adhesive is dried in about 7 to about 12 seconds after its application to the substrate.

BRIEF DESCRIPTION OF THE DRAWINGS

A better understanding of the present invention may be had from the consideration of the following detailed description, taken in conjunction with the accompanying drawings, in which.

DETAILED DESCRIPTION

Figure 1:
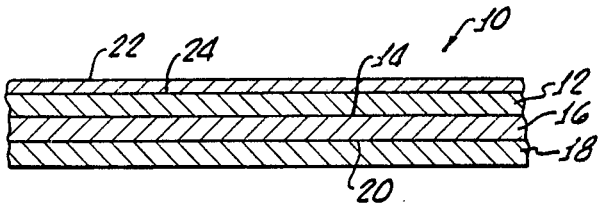
FIG. 1 is a cross-sectional view of the thermosensitive label with remoistenable adhesive in accordance with the present invention, generally showing each of the layers.

Turning to FIG. 1 a thermosensitive label 10, in accordance with the present invention, is shown in cross-section with a thermosensitive color-forming layer 12 disposed on one side 14 of a substrate 16 and a remoistenable adhesive 18 disposed on an opposite side 20 of the substrate 16. Also shown is a barrier layer 22 disposed over a top surface 24 of the thermosensitive color-forming layer 12 for preventing undesired color formation and/or fading of desired color formation in the color-forming layer by exterior contaminants.

In general, the thermosensitive color-forming layer may be of any suitable combination in which a display of images is produced when the temperature of selected portions of the thermosensitive color-forming layer are heated above an activated temperature. Such layers are well known in the art and may include a colorless or light-colored leuco dye and an acidic substance such as described in U.S. Pat. Nos. 4,370,370 and 4,388,382.

In use, a heated printing head (not shown) may be utilized to selectively heat portions of the color-forming layer, as is well known in the art. In this manner, the thermosensitive color-forming layer provides a means for creating a display of images without the use of oily or water-based inks.

Any suitable paper stock type substrate 16 may be used in the manufacture of the present invention. However, a feature of the present invention enables the use of uncoated paper stock at considerable cost savings, because the hereinafter described remoistenable adhesive layer 18 does not include any components which would cause color formation or fading of color images in the thermosensitive color-forming layer should they migrate through the substrate and into the color-forming layer.

This problem was hereinbefore pointed out with regard to prior art labels using pressure-sensitive adhesives. Pressure-sensitive adhesives include solvents, plasticizers or binders which have been known to cause fading or color formation in the color-forming layer 12. Hence, the elimination of such adhesives enables a label made in accordance with the present invention to be absent a barrier (not shown) disposed on the substrate between the color-forming layer 12 and the adhesive 18.

Turning to the remoistenable adhesive 18, it has been found that certain adhesives may be successfully used without a barrier layer between the adhesives and the color-forming layer, and such adhesives are those that comprise components not causing color formation or fading of images created in the color-forming layer. Such components causing degradation to the color-forming layer include plasticizers and binders are found in common organic-solvent-type adhesives.

Remoistenable adhesives suitable in the present invention comprise water-soluble or water dispersible components such as casein-vinyl acetate adhesives.

In order to enable manufacture, the label in accordance with the present invention, at commercial production rates, it has been found that a remoistenable adhesive comprising casein-vinyl acetate, suitable in the present invention, should have a solids content of at least about 70 percent by weight when applied to the opposite side 20 of the substrate 16. A suitable casein-vinyl acetate adhesive is available from National Starch and Chemical Corporation of Bridgewater, N.J., under the trade name of Royaldex 32-3405.

A suitable commercial manufacturing rate for the label of the present invention is between about 90 meters and about 120 meters per minute, which means that the adhesive must be dried after application to the substrate 16, between about 7 and about 12 seconds.

This drying, of course, must be accomplished without heating of the label, and color-forming layer thereon, above the activation temperature of the thermosensitive color-forming layer, the latter typically being at most 60 degrees centigrade. Activation temperature, as the term is used in this specification, is meant to be the initial activation temperature of the color-forming layer. As is well known in the art, the activation of a color-forming layer begins at a temperature at which color formation first occurs. Higher temperatures cause color formation with a higher optical density. In the color-forming layer useful in the present invention, it is expected that a maximum color density occurs at temperatures above about 100° C.

It has been found that drying speeds in this order can be achieved when the remoistenable adhesive layer 18 is applied with a thickness of between about 0.5 mil and 1.5 mil and thereafter air dried with room temperature air blown over the layer at about 17 $m^3$ per minute. It should be appreciated that the thickness of the adhesive, the temperature of the adhesive, and the amount of air necessary to dry the adhesive in the prescribed time, are all interrelated. In addition, the viscosity of the adhesive is known to vary with temperature, as set forth in Table 1. Hence, it should be appreciated that these perimeters can be adjusted and determined by a simple trial and error experimentation through a variation thereof, to enable high speed commercial production of the label by quick drying of the remoistenable adhesive on the substrate.

Specifically, the adhesive layer 18, may have solids content of about 71 percent, a viscosity of about 7000 cps at room temperature and may be applied in the conventional manner onto the substrate 16, as hereinafter shown.

When it is expected that a label in accordance with the present invention may be subjected to contaminants in the atmosphere, such as oils, solvents or plasticizers on adjacent goods which may migrate into the color-forming layer, through a top surface 24 thereon, the barrier layer 22 shown in FIG. 1 may be utilized.

TABLE I

| TEMPERATURE vs. VISCOSITY TABLE - 32-3405 | |
|---|---|
| TEMPERATURE (°F./C.) | VISCOSITY (CPS) |
| 70/21.1 | 7,750 |
| 75/23.9 | 7,000 |
| 80/26.7 | 5,800 |
| 85/29.4 | 5,200 |
| 90/32.2 | 4,250 |
| 95/35.0 | 4,100 |
| 100/37.8 | 3,550 |
| 105/40.6 | 3,450 |
| 110/43.3 | 3,300 |
| 115/46.1 | 2,900 |
| 120/48.9 | 2,000 |

This barrier layer 22 may be any suitable water-soluble resin solution which is supplied by sufficient thickness to prevent subsequent deterioration of the thermosensitive color-forming layer 12, via exterior contaminants.

Figure 2:
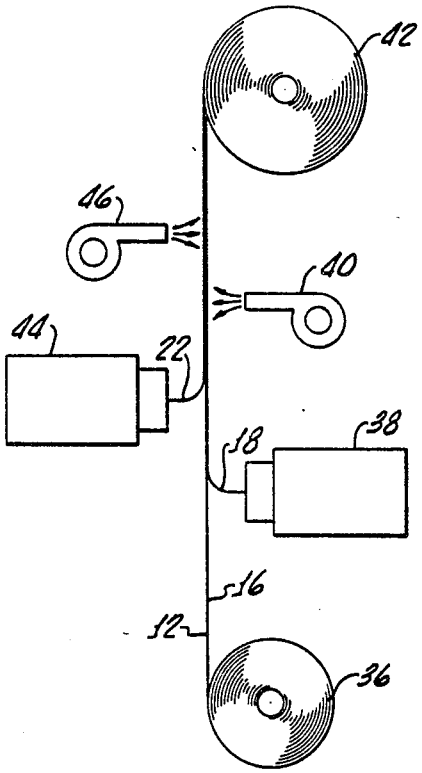
FIG. 2 is a diagram showing the production of a thermosensitive recording label with remoistenable adhesive in accordance with the present invention showing the application and drying of a remoistenable adhesive on a substrate, as well as the application of a color-forming layer and a barrier layer onto the substrate and color-forming layer, respectively.

As generally shown in FIG. 2, the adhesive layer 18 may be applied to the substrate 16 onto which the thermosensitive color-forming layer 12 has already been disposed and provided in the form of a roll 36.

It is important to appreciate that the color-forming layer 12 is disposed on the substrate in a conventional manner and that this process is preferably executed with the substrate having adhesive already disposed thereon, because the water-based color-forming layer must be applied in liquid form and dried. In this operation, water and humidity may activate the remoistenable adhesive and cause unwanted adhesion to equipment and gumming up of the label. Hence, it is expected that for commercial production of the present label, the adhesive layer 18 is preferably disposed onto the substrate 16 subsequent to the placement of the thermosensitive color-forming layer 12 thereon.

As shown in FIG. 2, the adhesive 18 may be applied by a conventional extruder 38, or rollers, not shown, and thereafter air dried with a blower 40 without reaching the activation temperature of the thermosensitive color-forming layer 12 before it is formed into a roll 42 for storage.

The barrier layer 22 may be placed onto the thermosensitive color-forming layer shortly after the placement of the color-forming layer 12 on the substrate 16. It also may be applied in a conventional manner by an extruder 44, or roller, not shown, or the like, in a contemporaneous manner, with the adhesive, and thereafter dried by passing past a blower 46.

The following example is presented by way of illustration only, and is not to be considered limiting to the present invention.

EXAMPLE 1

A solution of leuco dye and acid substance was prepared as follows:

| | Parts by Weight |
|---|---|
| Dispersant A | 1.5 |
| 3-diethyl-6-methyl-7-anilino fluoran | |
| Polyvinyl alcohol (20% aqueous solution) | 5.0 |
| Water | 43.5 |
| Dispersant B | |
| Bisphenol A | 6.0 |
| Stearic acid amide | 1.0 |
| Polyvinyl alcohol (20% aqueous | 10.0 |

-continued

| | Parts by Weight |
|---|---|
| solution) | |
| Water | 33.0 |

The prepared Dispersant A and Dispersant B were mixed to form a thermosensitive coloring liquid which was applied to a substrate consisting of high quality uncoated paper weighing about 64 gr./m$^2$, and thereafter dried at room temperature up to 120° C. to form a thermosensitive color-forming layer in which the solids therein amounted to about 4.0 to about 10 gr./m$^2$. Thereafter, a water-soluble resin solution comprising 5 parts of polyvinyl alcohol in 95 parts of water was applied to the heat-sensitive color-forming layer and dried at a temperature less than 120° C. to thereby form a barrier layer over the thermosensitive color-forming layer, said barrier layer having a quantity of solids of about 2 gr./m$^2$.

A casein-vinyl acetate adhesive (National Starch and Chemical Royaldex 32-3405) having a solids content of about 71 percent was applied with a viscosity of about 7000 cps at about 24° C. and blown dried with air at less than 60° C. in about 10 seconds, with a resulting dried thickness of adhesive of about 1 mil.

The resulting label was then contacted with a thermal printing head to cause a preselected image to form in the color-forming layer and the label was then applied to paper stock by moistening the remoistenable adhesive and contacting it with the paper stock. No color formation occurred in the color-forming layer during production thereof and no subsequent color fading of the preselected image or unwanted color formation occurred following application of the label to the paper stock.

Although there has been described hereinabove a specific thermal label with remoistenable adhesive and method of manufacture in accordance with the present invention for the purposes of illustrating the manner in which the invention may be used to advantage, it should be appreciated that the invention is not limited thereto. Accordingly, any and all modifications, variations or equivalent arrangements which may occur to those skilled in the art should be considered to be within the scope of the invention as defined in the appended claims.

What is claimed is:

1. A thermosensitive label comprising:

a substrate;

thermosensitive color-forming layer means, disposed on one side of said substrate, for creating a display of images when the temperature of selected portions of the thermosensitive color-forming layer means are heated above an activation temperature; and a remoistenable adhesive disposed on an opposite side of said substrate, said remoistenable adhesive being disposed on said substrate in a viscous form and dried on the substrate without heating the thermosensitive color-forming layer above the activation temperature, said remoistenable adhesive comprising components not causing color formation or fading of images created in the thermosensitive color-forming layer, said remoistenable adhesive comprising a water-soluble or water dispersible casein-vinyl acetate having a solids content of at least about 70 percent by weight when applied to the opposite side of the substrate.

2. The thermosensitive label according to claim 11 wherein the remoistenable adhesive has a thickness between about 0.5 mil and 1.5 mil.

3. The thermosensitive label according to claim 2 wherein the thermosensitive color-forming layer comprises a colorless or light-colored leuco dye and an acidic substance capable of causing said leuco dye to undergo color-formation upon heating of the thermosensitive label to a temperature greater than the activation temperature.

4. The thermosensitive label according to claim 3 wherein the activation temperature is at most 60 degrees centigrade.

5. The thermosensitive label according to claim 4 further comprising barrier means, disposed over said thermosensitive color-forming layer means, for preventing undesired color formation and/or fading of desired color formation in the color-forming layer by exterior contaminants.

6. A thermosensitive label comprising:

a substrate comprising uncoated paper stock;

thermosensitive color-forming layer means, disposed on one side of said substrate, for creating a display of images when the temperature of selected portions of the thermosensitive color-forming layer means are heated above an activation temperature, said thermosensitive color-forming layer means comprising a colorless or light-colored leuco dye and an acidic substance capable of causing said leuco dye to undergo color formation upon heating to a temperature greater than the activation temperature;

barrier layer means, disposed on said thermosensitive color-forming layer means, for preventing undesired color-formation and/or fading of desired color formation in the color-forming layer by exterior contaminants; and a remoistenable adhesive disposed on an opposite side of said substrate by applying said remoistenable adhesive in a viscous form and drying the remoistenable adhesive on the substrate without heating the thermosensitive color-forming layer above the activation temperature, said remoistenable adhesive comprising a casein-vinyl acetate having a solids content of about 70 percent by weight when applied to the opposite side of the substrate and a viscosity of at least about 4000 cps.

7. The thermosensitive label according to claim 6 wherein the remoistenable adhesive has a thickness between about 0.5 mil and 1.5 mil.

8. The thermosensitive label according to claim 7 wherein the activation temperature is at most 60 degrees centigrade.

* * * * *